US005267535A

United States Patent [19]

Luo

[11] Patent Number: 5,267,535

[45] Date of Patent: Dec. 7, 1993

[54] ROTARY EXHAUST VALVE FOR TWO-STROKE ENGINE

[75] Inventor: Jih-Tzang Luo, Hsinchu, Taiwan

[73] Assignee: Industrial Technology Research Institute, Hsinchu, Taiwan

[21] Appl. No.: 572,039

[22] Filed: Aug. 22, 1990

[51] Int. Cl.[5] ..... F01L 7/12

[52] U.S. Cl. ..... 123/65 PE; 123/190.3

[58] Field of Search ..... 123/65 PE, 65 P, 73 PP, 123/190 AA, 568; 60/304, 314

[56] References Cited

U.S. PATENT DOCUMENTS

| | | | |
|---|---|---|---|
| 4,570,439 | 2/1986 | Uchinishi | 60/314 |
| 4,848,279 | 7/1989 | Luo | 60/314 |
| 4,924,819 | 5/1990 | Boyesen | 123/65 PE |
| 4,969,329 | 11/1990 | Bolton et al. | 123/65 PE |

FOREIGN PATENT DOCUMENTS

| | | | |
|---|---|---|---|
| 0081109 | 5/1982 | Japan | 123/65 PE |
| 0243923 | 10/1987 | Japan | 123/65 PE |

*Primary Examiner*—E. Rollins Cross
*Assistant Examiner*—Erick Solis
*Attorney, Agent, or Firm*—Flehr, Hohbach, Test, Albritton & Herbert

[57] ABSTRACT

A two-stroke engine with a rotary exhaust valve being provided in the vicinity of the exhaust part of the engine; the rotary exhaust valve rotates in a contrary direction to the rotating direction of the engine crank and at a speed equal to one-half that of the crank. During final exhaust stage, the exhaust passage is closed so as to prevent the fresh fuel gas from being exhausted before being burned.

6 Claims, 2 Drawing Sheets

ROTARY EXHAUST VALVE FOR TWO-STROKE ENGINE

BRIEF DESCRIPTION OF THE INVENTION

The present invention relates generally to an exhaust valve for an internal combustion engine. More particularly it relates to a rotary exhaust valve for a two-stroke engine which closes the exhaust port to prevent the escape of fresh mixture through the exhaust port during the final stage of the exhaust stroke of the piston.

BACKGROUND OF THE INVENTION

A two-stroke engine, as compared to a four stroke engine, has the advantages of simple structure, low manufacturing cost, easy maintenance and steady output of horse power. However, it also has the disadvantages of higher fuel consumption and higher air pollution. Since they have such an impact on air pollution, the public has occasionally recommended a prohibition of two-stroke engines.

In the conventional two-stroke engine, a fuel-air mixture is charged into the cylinder. After the compression stroke of the piston the mixture is ignited. The exhaust gases are forced out of the cylinder through an exhaust port by the exhaust stroke of the piston while the fresh fuel-air mixture is added. The exhaust port remains partially open while the piston is completing the exhaust stroke, so some of the fresh fuel-air mixture escapes into the exhaust port. When the engine is operating at large throttle opening, more fuel-air mixture is lost through the exhaust port because of the strong suction in the expansion chamber which is created by expansion of waste gas and its kinetic energy.

The amount of fuel-air mixture lost during operation of a conventional two-stroke engine is within the range of 25% to 40%. This loss of fuel reduces the fuel economy of the engine. The escaped fuel-air mixture also worsens the pollution caused by the engine. The gas which escapes from the cylinder during the final stage of the exhaust stroke contains more hydrocarbons, and has a higher density of burnable gas, than the prior exhaust gas. An engine which reduces the amount of unburned fuel which escapes from the cylinder would have a better fuel economy, and less emission.

OBJECTS AND SUMMARY OF THE INVENTION

It is a general object of the present invention to provide an exhaust valve for an internal combustion engine which enables exhaust gases to escape through the exhaust port while keeping the fuel-air mixture within the combustion chamber.

It is a further object of the present invention to provide an exhaust valve for a two-stroke engine which, during the final stage of the exhaust stroke, reserves the latest exhaust gas which is rich in hydrocarbons and returns it later to the crankcase for use in the next cycle.

It is a particular object of the present invention to provide a rotary exhaust valve which regulates the flow of exhaust gas in response to the movement of the piston.

The foregoing and other objects are achieved by a rotary exhaust valve for a two-stroke engine which includes a piston assembly, a cylinder assembly including a combustion chamber, a crankcase, a crank apparatus for manipulating the piston assembly, an air passage and a gas-return passage formed adjacent to an exhaust passage on the cylinder. The exhaust valve located among the air passage, the gas-return passage and the exhaust passage includes a valve passage which periodically connects the combustion chamber to the exhaust passage, allowing the exhaust gas to escape from the engine. The exhaust valve also periodically connects the air passage to the gas-return passage, causing the reserved exhaust gas in the valve passage to be returned to the crankcase. A transmission apparatus connects the exhaust valve with the crankcase apparatus, allowing the exhaust gas to escape through the exhaust passage during the stage of the exhaust stroke, and reserving the latest exhaust gas for returning it to the crankcase after the stage of the exhaust stroke.

BRIEF DESCRIPTION OF THE DRAWINGS

Other objects and advantages of the present invention will become apparent upon reading the following description and upon reference to the drawings, in which.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
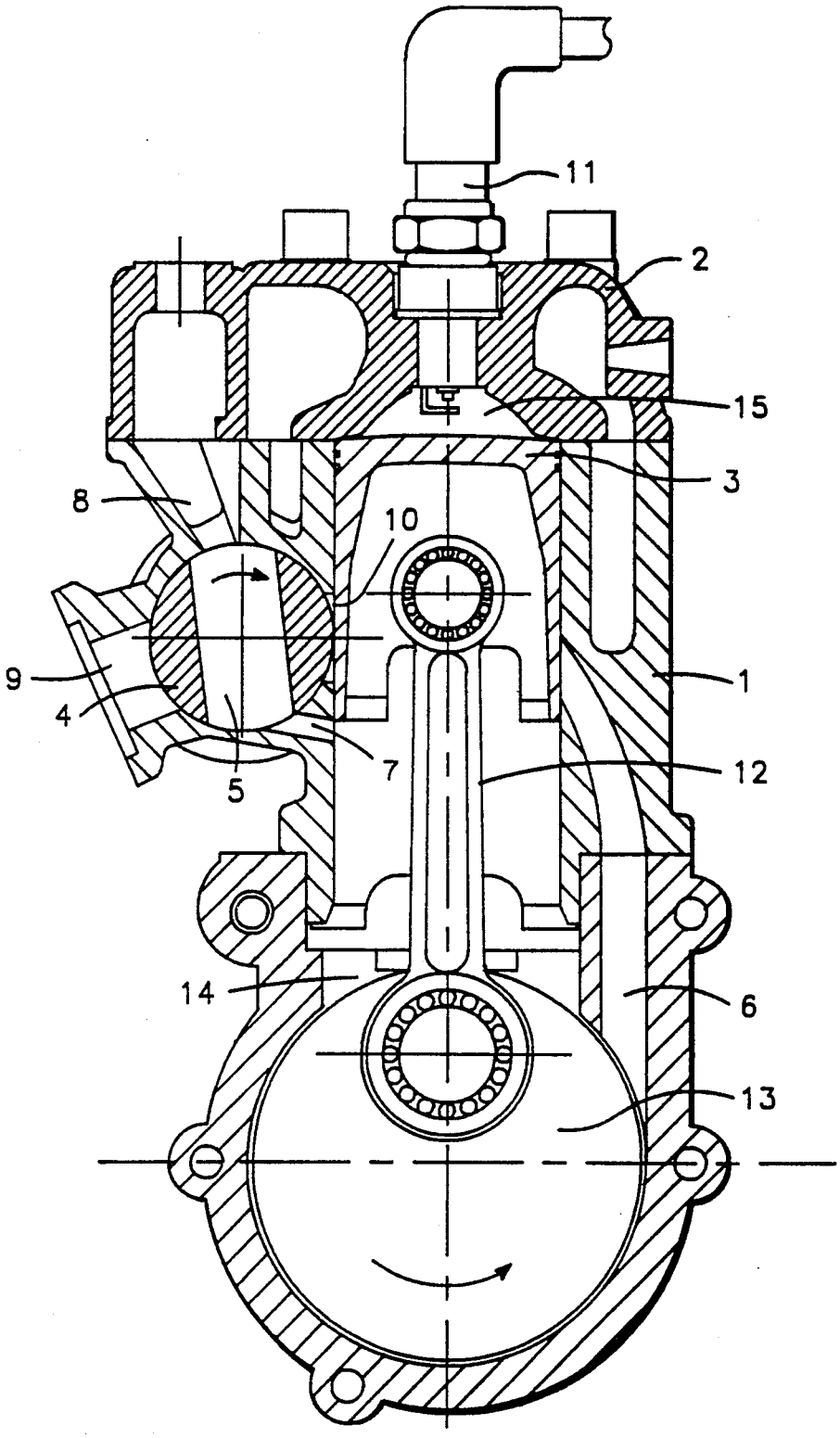
FIG. 1 is a sectional view of a two-stroke engine with a rotary exhaust valve in accordance with the present invention.

Referring to FIG. 1, there is shown a sectional view of an embodiment according to the present invention, in which a head 2 is mounted over the cylinder block 1. A spark plug 11 is installed through the central part of the cylinder head, and a piston 3 is fitted in chamber 15 of the cylinder block 1. The piston 3 is connected through a connecting rod 12, with the crank 13, which is installed inside a crankcase 14 fixedly mounted under the cylinder block The cylinder head 2 is furnished with an air passage 8 and a rotary exhaust valve 4, of which the central portion has a valve passage 5. The rotary exhaust valve 4 is installed between the cylinder exhaust port 10 and an exhaust passage 9. Both ends of the rotary exhaust valve 4 are supported with bearings (not shown). The rotary exhaust valve 4 rotates at a speed of one-half that of the crank 13 and in a direction opposite that of the crank. A gas-return passage 7 is formed in the walls of the cylinder block providing communication between the rotary exhaust valve 4 and the crankcase 14. In the cylinder block 1, there is a scavenging port 6 to communicate the crankcase 14 with the chamber 15 for delivering fuel-air mixture.

During its operation a fuel-air mixture is filled in the crankcase 14 from a carburetor or by a nozzle (not shown) where it is somewhat compressed before it scavenges into the cylinder chamber 15. The fuel-air mixture is then compressed by the piston 3 and ignited by the spark plug 11. As the piston 3 moves down, the exhaust gases are allowed to escape through the exhaust port 10.

Figure 2:
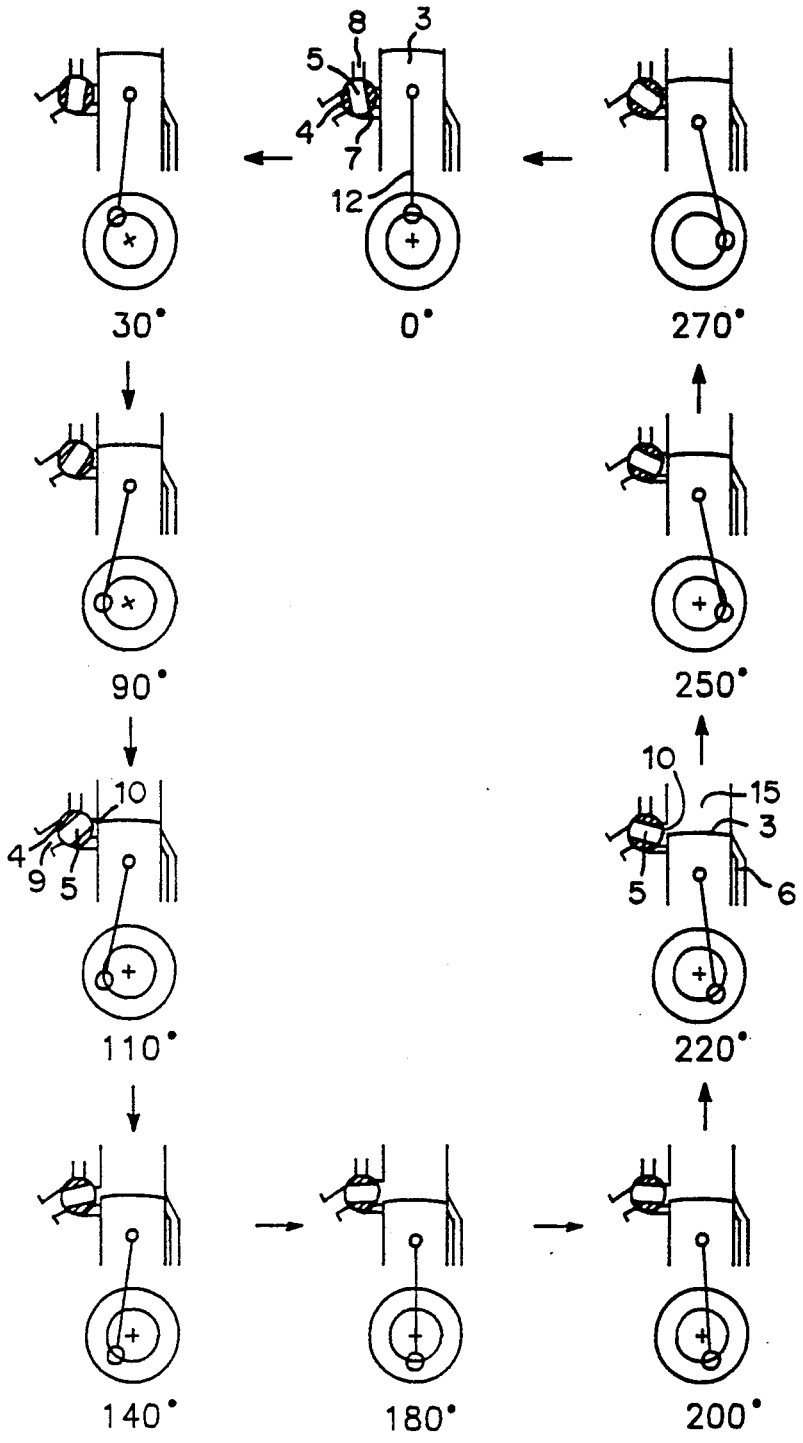
FIG. 2 illustrates the consecutive steps of the operating cycle of a two-stroke engine with a rotary exhaust valve in accordance with the present invention.

FIG. 2 illustrates the consecutive steps of the engine operating cycle in which the crank angle is measured along the center of the crank 13. The starting point of the crank angle is set at a point where the connecting point between the crank 13 and the connecting rod 12 is aligned with the top dead center.

When the crank angle is zero, the piston is at the top dead center while the compressed mixture in combustion chamber 15 is ignited, and the two ends of the valve passage 5 of the rotary exhaust valve 4 provides communication between the air passage 8 and the gas-return passage 7.

As the piston 3 is driven by pressure of expanding burned gas to an angle of about 110°, the valve passage 5 of the rotary exhaust valve 4 begins to align with the exhaust port 10, and the waste gas will be exhausted through exhaust port 10, the valve passage 5, the exhaust passage 9.

As the crank 13 reaches an angle of about 220°, the piston 3 is moving upwards, and the valve passage 5 begins to move downward to close the exhaust port 10 (simultaneously, the scavenging port 6 will also be closed by the piston 3). As the piston 3 moves farther upwards, the exhaust port 10 is completely closed and new fuel filled into the chamber 15 will not be leaked out of the exhaust port 10.

As soon as the piston 3 returns to the top dead center (i.e., the crank angle being at zero degrees), the gas-return passage 7 and the air passage 8 will be in communication with each other through the valve passage 5. At this time, the outlet of the gas-return passage 7 will be opened under the piston skirt. At t he same time, the space under the piston skirt (i.e., the crankcase) will have a negative pressure. The atmospheric pressure will push fresh air through the air passage 8 so as to drive the waste gas reserved in valve passage 5 during the final exhausting stage through the gas-return passage 7, and finally into the crankcase for re-use.

According to the embodiment of the present invention, a rotary exhaust valve 4 is installed in the vicinity of the exhaust port 10. The rotating direction of the rotary valve 4 is contrary to that of the crank 13 and the rotating speed of the rotary exhausting valve 4 is equal to one-half of that of the crank 13.

The aforesaid structure according to the present invention improves the drawback of poor fuel consumption in a two-stroke engine.

In the conventional two-stroke engine, when the piston moves upwards during the final stage of the exhaust stroke, the exhaust port is not closed completely. At lower rotating speeds, fresh fuel gas is pushed by the piston out of the exhaust port. At higher rotating speeds the fresh fuel gas scavenging into the combustion chamber will actually be sucked out of the exhaust port by the negative pressure created by the velocity of waste gas stream exhausting through the exhaust port.

The aforesaid loss of fresh fuel gas is at the maximum during the final stage of the exhaust stroke. Furthermore, the waste gas exhausted during the final stages of the exhaust stroke is the most dense waste gas in terms of containing hydrocarbons, thereby providing, in combination with the exhausted fresh fuel gas a substantial amount of air pollution.

In the present invention, the rotary exhaust valve 4 prevents the fresh fuel gas from being exhausted. Simultaneously the air passage 8 and the gas-return passage 7 can recover the most dense waste gas for re-use. Consequently, the present invention is deemed to improve the quality of waste gas exhausted, to save fuel, and to gain more horse power.

What is claimed is:

1. In a two-stroke engine, having a block, including a cylinder, a cylinder head, a piston, a crank, a crankcase, an inlet air passage, an exhaust port and an exhaust passage, a rotary exhaust valve installed in the vicinity of the exhaust port, said rotary exhaust valve including a through valve passage constituting a chamber, said rotary exhaust valve being operable during the final stage of the exhaust stroke for closing the exhaust port of said engine whereby leakage of fresh fuel gas through said exhaust port is prevented and further operable during the initial stage of the intake stroke to provide communication from said inlet air passage to said crankcase whereby gases remaining in said chamber are passed into said crankcase.

2. In a two stroke engine, a rotary exhaust valve, as defined in claim 1, together with means for rotating said exhaust valve in a direction contrary to that of the crank and at a speed of rotation one-half that of the crank.

3. In a two stroke engine, having a block, including a cylinder, a cylinder head, a piston, a crank, a crankcase, an exhaust port and an exhaust passage, a rotary exhaust valve disposed between the exhaust port and the exhaust passage of said engine; said rotary exhaust valve including a through valve passage; said cylinder head forming an air passage above said rotary exhaust valve; said block forming a gas return passage below said rotary exhaust valve providing communication between said exhaust valve and said crankcase, the outlet of said gas return passage being below the lower edge of the piston of said engine when said piston is at top dead center of its stroke while said gas return passage is in communication with said air passage through said rotary exhaust valve; said rotary exhaust valve being operable during the final stage of the exhaust stroke for closing the exhaust port of said engine whereby leakage of fresh fuel gas through said exhaust port is prevented.

4. The method of operating a two stroke engine with a rotary exhaust valve comprising the steps of opening the valve to exhaust waste gas at the stage of the exhaust stroke, closing the valve to prevent the exhaust of gas at the end of the exhaust stroke and passing the waste gas reserved in the exhaust valve and atmospheric air to the crankcase after the final stage of the exhaust stroke.

5. A rotary exhaust valve apparatus for an internal combustion engine, comprising:

(a) a piston assembly including a piston;

(b) a cylinder assembly including a cylinder block, a combustion chamber, an exhaust passage and a cylinder head;

(c) crank means for permitting movement of said piston assembly between a top center position and a bottom center position in said cylinder assembly, said crank means including a crankcase chamber;

(d) a gas-return passage means for collecting waste gas, said gas-return passage means opening into said crankcase;

(e) air passage means for allowing an air flow to pass from the atmosphere to said gas-return passage means when said air passage means and said gas-return passage means are connected together;

(f) exhaust valve means for regulating the transfer of said waste gas, said exhaust valve means including a valve passage which is periodically in communication with said exhaust passage and said combustion chamber allowing said waste gas to leave said cylinder assembly via an exhaust port, said valve passage also being periodically in communication with said air passage means and said gas-return passage means allowing said air flow to drive a portion of said waste gas that is reserved in said valve passage means and said gas-return passage means and into said crankcase assembly; and (g) driving means for rotating said valve means such that, when said piston is approximately at said top center position said valve passage connects said air passage means to said gas-return passage means, and when said piston assembly is in an exhaust stroke, said valve passage connects said combustion chamber to said exhaust passage.

6. A rotary exhaust valve apparatus as described in claim 5 wherein said driving means rotates said exhaust valve means in a direction contrary to that of said crank means and at a speed of rotation one-half that of said crank means.

* * * * *